United States Patent [19]

Atkins

[11] 4,058,311

[45] Nov. 15, 1977

[54] METAL FRAME RACKET

[76] Inventor: Lenard W. Atkins, 60A Port Road, Alberton, Australia

[21] Appl. No.: 694,474

[22] Filed: June 9, 1976

[51] Int. Cl.[2] ..... A63B 49/02

[52] U.S. Cl. ..... 273/73 G

[58] Field of Search ..... 273/73 R, 73 C, 73 D, 273/73 G, 73 H

[56] References Cited

U.S. PATENT DOCUMENTS

| | | | |
|---|---|---|---|
| 1,122,159 | 12/1914 | Richey | 273/73 G |
| 3,844,556 | 10/1974 | Fee | 273/73 G |

FOREIGN PATENT DOCUMENTS

| | | | |
|---|---|---|---|
| 253,694 | 8/1964 | Australia | 273/73 H |
| 246,763 | 2/1926 | United Kingdom | 273/73 G |
| 228,650 | 2/1925 | United Kingdom | 273/73 H |

*Primary Examiner*—Richard J. Apley
*Attorney, Agent, or Firm*—Oldham & Oldham Co.

[57] ABSTRACT

A tubular stainless steel tennis racket with the head and handles being formed from a single piece of tubular steel. An infill piece bridges the handles to complete the head, and in order to pevent fracture at the throat a pair of U-shaped clips bridge the angle between the handles and the infill piece.

3 Claims, 4 Drawing Figures

METAL FRAME RACKET

This invention relates to metal rackets and more particularly to metal rackets formed of stainless steel tubing.

DESCRIPTION OF THE PRIOR ART

Conventionally rackets particularly for tennis and squash have been of laminated wooden construction, but these have the known disadvantages of warping and breaking. Hence over recent years considerable development has been made in the field of metal rackets, some of these having been made utilising stainless steel, aluminium either drawn or cast, and various alloys of metals.

However as far as the Inventor is aware none of these has been entirely satisfactory. If the frame is made in a manner to preclude fracture, particularly at the throat where the handle joins the head of the racket, then the frame is often so rigid that the required action is not achieved, for the strings only are providing the action on the ball. This is particularly noticeable with some rackets where the ball, if it strikes the centre of the string area has a fairly satisfactory action, but if the ball strikes outside this central area the required action is not achieved and the racket could be said to be dead.

Various rackets have been made with either a cast head and handle, or with the head and handles being fabricated out of tubular metal. In this way there is required a join to be made at the throat where the head is incomplete, or where the handle joins the head, and it is at this juncture where cracking and fracture usually occurs.

SUMMARY OF THE INVENTION

It has been found that when a ball is struck by a racket, that the head of the racket tends to flex backwardly usually to a very small extent, and not only does this flexing occur, but the frame often tends to twist about an axis passing longitudinally through the section of the frame, and from investigations it has been determined that while the flexion had been thought to be the sole cause of fracture, that more importantly it is the twisting moment about the axis of the section of the frame this is the prime cause of fracture.

It has been found that by addition of a wire clip or other reinforcing member to reinforce this juncture of the handle to the racket head at each side of the handle and head, that an improved form of racket is achieved. This wire like clip which in effect passes on each side face of the racket allows the required flexing, but at this juncture minimises the twisting to such a degree that fracture or cracking at this juncture is virtually eliminated.

If instead a web or strut were placed in the angle so formed to be joined to the handle and head portion this web may minimise flexing at the point but would not to any degree minimise the twisting moment.

Thus by having a clip in the form of a U having arms which straddle the sides of the handle portion and the infill portion and is securely united thereto effectively minimises this twisting effect.

DESCRIPTION OF THE PREFERRED EMBODIMENT

Figure 1:
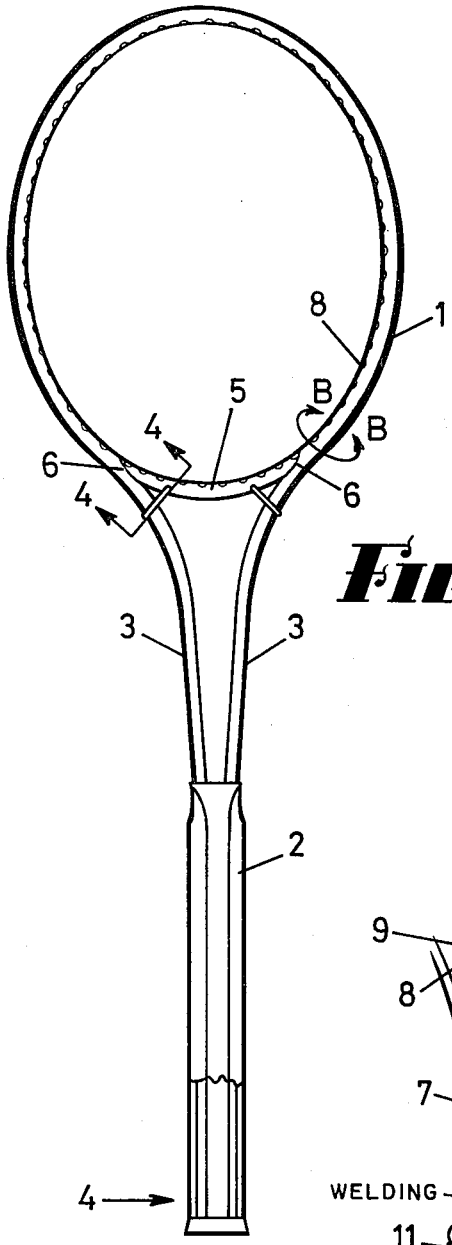
FIG. 1 is a face view of a racket according to the invention.
Figure 2:
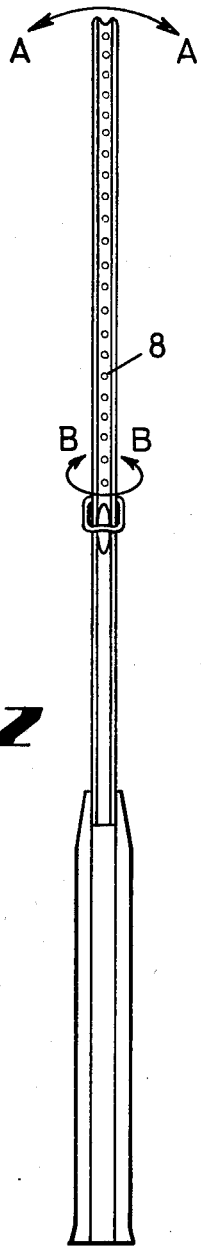
FIG. 2 is an edge view thereof.
Figure 4:
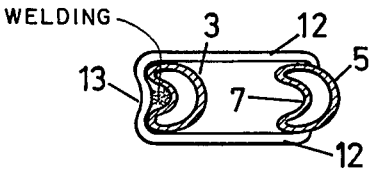
FIG. 4 is a sectional view along the lines 4-4 of FIG. 1.
Figure 3:
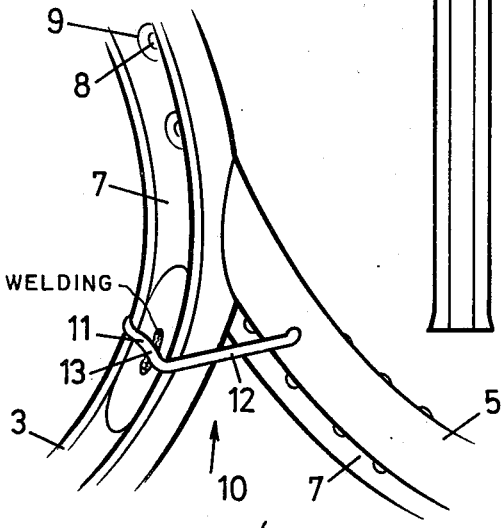
FIG. 3 is a view of the reinforcement to an enlarged scale.

The racket shown comprises a head 1 joined to a handle 2, the handle being joined by handle portions 3 to the head 1. The head 1 and the handle portions 3 are formed from a piece of tubular stainless steel which extends continuously from the extreme end of the handle 4 to form the handle portions 3 around in a smooth loop to form the head and thence to the other handle portions 3 and terminate at the handle end 4. To complete the head 1 an infill or throat piece 5 is welded into the space by welding to the ends of the handle portions 3 at position 6 to form a smooth continuance of the head 1.

The tubular stainless steel is formed with a re-entrant portion to form a groove 7 extending along the length of the tube. At spaced locations holes 8 are formed through the tube, these being spaced as desired for the stringing of the racket. At each hole eyelets 9 which have smoothly curved entrances to the passage through the eyelet are inserted, so that on stringing the strings are curved in a smooth arc so that no sharp edges or corners exist which can damage a string. Thus it will be seen that due to the re-entrant groove 7, that the strings are protected and that damage to the strings will not occur when the racket strikes the ground or other obstacle.

As mentioned earlier when the ball is struck the racket flexes generally as indicated by the arrows A—A this flexing producing a movement at the tip or end of the racket, and generally flexes about the area of the throat of the racket. The action of striking a ball also produces a twisting moment about the frame, this twisting moment being generally shown by the arrows B—B, and it has been determined that it is this twisting moment which causes fracture and breakage in the area of the throat.

A generally U-shaped clip 10 having a base 11 and arm 12 bridges the angle formed between each handle portion 3 and the infill piece 5. The clip 10 at its base 11 is formed with a depression or re-entrant portion 13 which at least partially enters the groove 7. At this juncture the clip is welded into the groove 7, there being a slight build up of weld metal to join the groove 7 to the re-entrant portion 13 of the clip 10. At its ends the arms of the clip are welded to the sides of the infill piece 5. It will be seen that the clip by having two arms effectively minimises the twisting effect on the frame, for any twisting effect will have the action of placing one arm 12 in tension and the other arm 12 in compression.

If for example a single strut or spacer on the centre line of the handle portions 3 and infill piece is used and inserted into the groove 7 of the infill piece, this does not effectively prevent the twisting effect, and the Applicant has found that such a bracing member is not as effective as in the present invention.

Thus the present invention provides a racket which is of light weight, and has the desired action on the ball. The clip 10 does not add any material weight to the racket, and also does not create any further air resistance as the racket is swept through the air, the two arms spanning the angle shown to produce the strength required but without effecting the performance of the racket.

I claim:

1. A racket of the metal frame type, the racket being formed of a piece of metal tube forming the head and handle of the racket, the tube being formed to merge progressively from the handle into the head, the head being completed by an infill piece bridging the two portions forming the handle at the throat of the racket, the tube being formed of a re-entrant groove extending around the outside of the racket, characterized by a stengthening U-shaped clip bridging each angle formed by the infill piece joining the handle portions, each strengthening clip having a pair of arms straddling the handle portions and the infill piece and a re-entrant portion to enter the groove of the tube of the handle portion, and being welded thereto so that when a twisting action tends to occur on the frame, the strengthening member resists this action while not inhibiting the flexing action of the racket.

2. A racket of the metal frame type as defined in claim 1, characterized in that the arms of the stengthening clip are welded to the infill piece, and the re-entrant portion is welded to the groove of the handle portion of the tube.

3. A racket of the metal frame type as defined in claim 1 wherein the tube has spaced holes therethrough opening into the groove, and eyelets in the holes so that on stringing the strings are protected in the groove.

* * * * *